United States Patent [19]

McLeod et al.

[11] Patent Number: 5,005,251

[45] Date of Patent: Apr. 9, 1991

[54] ADAPTER FOR MOUNTING VACUUM MOTOR

[75] Inventors: Rick McLeod, Lake in the Hills; Gary E. Palmer, Roselle, both of Ill.

[73] Assignee: Hako Minuteman, Inc., Addison, Ill.

[21] Appl. No.: 424,382

[22] Filed: Oct. 20, 1989

[51] Int. Cl.[5] ..... A47L 9/22

[52] U.S. Cl. ..... 15/327.1; 15/327.2; 15/328; 15/412

[58] Field of Search ..... 15/412, 328, 327.2, 15/327.7, 327.1

[56] References Cited

U.S. PATENT DOCUMENTS 4,195,969 4/1980 Whitney ..... 15/412 X 4,654,926 4/1987 McCambridge ..... 15/328 X 4,746,092 5/1988 Hayashi et al. ..... 15/412 X 4,864,683 9/1989 Herron et al. ..... 15/412

*Primary Examiner*—Chris K. Moore

*Attorney, Agent, or Firm*—Emrich & Dithmar

[57] ABSTRACT

A structure is disclosed for receiving and securing one or more vacuum motors in the motor housing of a vacuum suction machine. The structure acts as an adapter to permit vacuum motors of different circumferential, as well as axial dimensions to fit into, and be secured in a housing of one shape and design. The same housing can be used with many different motor configurations and thus provide a wider range of static lift pressures and air volumes at reduced manufacturing cost.

9 Claims, 2 Drawing Sheets

ADAPTER FOR MOUNTING VACUUM MOTOR

FIELD OF THE INVENTION

The present invention relates to vacuum cleaning machines of the type used to suction dirt, debris or liquids; and it more particularly relates to industrial/-commercial vacuum machines of the type in which refuse, debris or liquids are collected in a drum-shaped canister, and wherein the power unit is located in a housing which seats on, and is sealed to the upper rim of the canister.

BACKGROUND OF THE INVENTION

It is desirable for a manufacturer to offer a wide-range of static lift pressures and air volumes for a line of industrial or commercial vacuum cleaning machines. These machines are rated in terms of the static lift and air volumes (in cubic feet per minute, for example), which are developed by the machine. The price of the machine, of course, increases with higher static lift and air volume ratings. The ratings of static lift and air volumes are related to the size and capacity of the vacuum motor as well as the number of stages in the fan assembly driven by the motor.

Typically, the motor is mounted in a housing and the entire housing and motor (sometimes referred to as the "vacuum power head") may be removed from the canister to empty the canister. It is thus desirable to mount different size motors in housings of the same exterior dimensions. Vacuum motors differ in diameter (i.e., circumference) and axial dimension, the motors having the larger capacities also being greater in size.

In the past, arrangements have been made to mount motors of the same circumference but different axial dimensions in a single housing by using annular seating gaskets of different depth so that the total axial dimension of the motor and gasket remain constant. Compensating for differences in the axial dimension of the fan housing of the vacuum motors through gaskets of different axial dimensions is not always desirable because the axial dimension of the gasket must be larger as the axial dimension of the vacuum chamber is smaller. With larger gaskets, for longer periods of use, the sealing ability of the gasket diminishes; and the ability of the motor to continue to generate the rated static lift diminishes as air leaks begin to form around the gasket.

Moreover, compensating for differences in axial dimension of the motor with gaskets does not permit the interchangeability of the vacuum chambers of different diameters. Current commercial technique does not permit the interchangeability of different numbers or configurations of motors having different diameters in the same housing, as does the present invention.

SUMMARY OF THE INVENTION

A primary feature of the present invention is that it accommodates different size vacuum motors, both axially and in diameter, as well as a multiplicity of motors in a single housing. The invention also permits a wide range of configurations of motors as well as configurations of different size motors to be accommodated by the same housing. For example, a single motor having a relatively large diameter fan chamber can be incorporated in the housing, or a plurality (one, two or three) of smaller motors can be accommodated in the same vacuum housing. Moreover, by inverting the housing it will accommodate the larger size vacuum motor having a different axial dimension of the fan chamber, permitting use of either a two-stage or three-stage motor. The invention will likewise permit one, two or three of the smaller size motors having a two-stage fan chamber, or it will permit one, two or three of the smaller size motors having three-stage fan chambers to be mounted in the same housing. There is thus a wide range of static lift and air volumes which can be provided economically in the same vacuum housing and employing the same canister to match the needs of the customer and yet reduce the cost of the manufacture by reducing the number of parts that must be made and stored in inventory.

The different configurations are permitted by means of a motor mounting adapter having a cylindrical outer wall and a transverse support wall which is mounted closer to one edge of the outer wall than it is to the other. The transverse wall is placed such that when the adapter is mounted with one side up, it will accommodate two-stage vacuum motors, but when it is inverted it will accommodate three-stage motors. The invention does not eliminate the use of gaskets because gaskets are necessary to provide the desired sealing of the motor, but it permits the use of gaskets having the same nominal thickness, thus obviating the need for larger, more pliable gaskets which are more prone to develop leaks.

Moreover, each side of the adapter is provided with a continuous intermediate lateral wall which is configured to include three partial wall sections of major circumference to receive respectively three individual motors of a smaller diameter. The intermediate lateral wall also includes three partial wall structures for receiving, in a central location, a single motor of the larger diameter vacuum chamber.

Thus, the present invention, through the intermediary of a single adapter structure, can accommodate eight different configurations or combinations of vacuum motors permitting eight different ratings of static lift and air volume, all accommodated in the same, identical housing structure.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF THE PREFERRED EMBODIMENT

Figure 1:
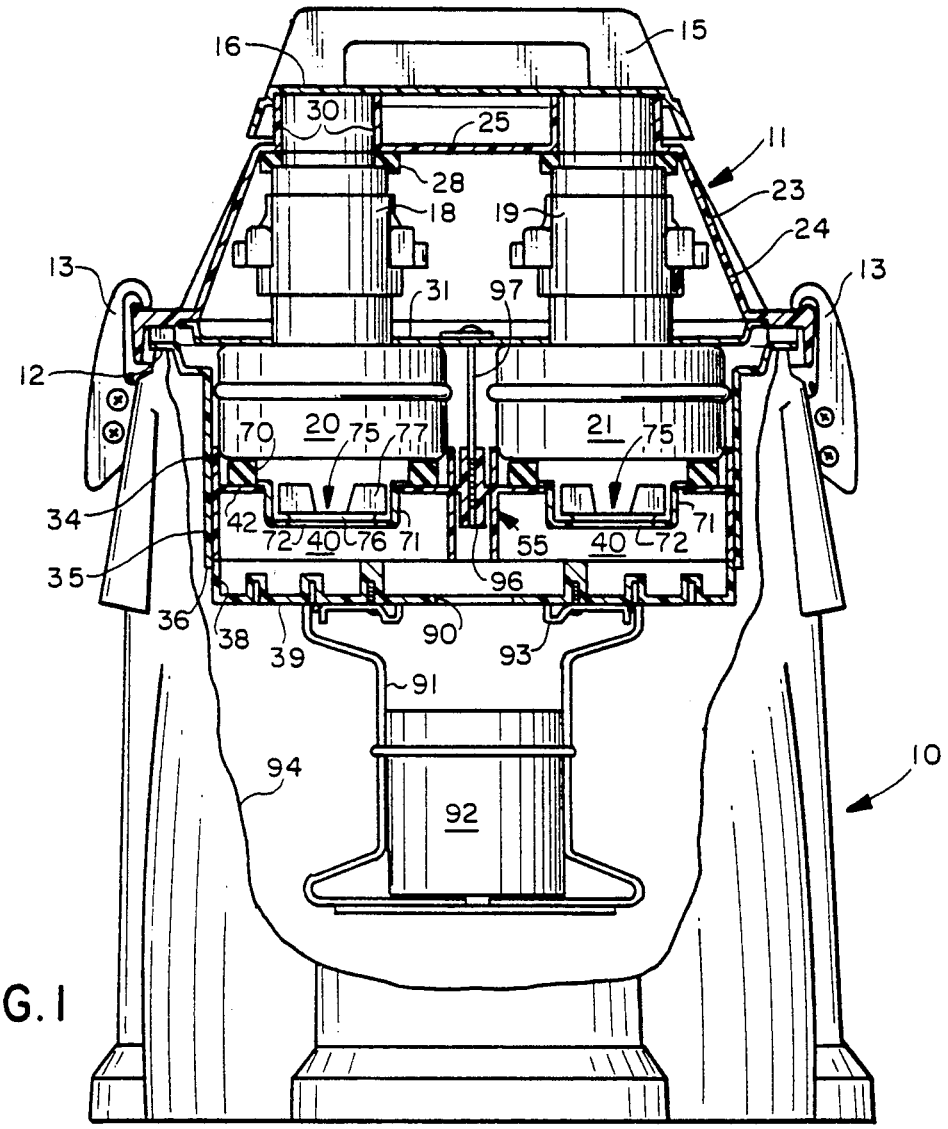
FIG. 1 is a side elevational view of a vacuum machine incorporating the present invention, with portions of the canister and power head broken away to illustrate interior components and structure.

Referring first to FIG. 1, reference numeral 10 generally designates a conventional tank or canister which serves as a reservoir for dust, debris or other refuse, including water, being collected. A vacuum is generated inside the tank 10 by one or more vacuum motors located in a power head 11 which is seated on and mounted to the upper horizontal rim 12 of the tank 10 by a pair of side latches 13.

The power head 11 houses the vacuum motors which generate the vacuum in the tank 10, and it also covers and seals the tank, as is well-known in the art. The power head 11 is removable from the tank when the latches 13 are unlocked, by means of a handle 15 which is mounted to a top or cover plate 16.

Briefly, the power head 11 illustrated in FIG. 1 includes two motors 18, 19 having associated respective fan chambers 20, 21. The motors 18, 19 are housed within a shroud 23 having a frusto-conical side wall 24 and a top plate 25. The top of motor 18 is secured to the top plate 25 of the shroud by means of a gasket 28.

A conventional air baffle assembly generally indicated at 30 is located between the top plate 25 of the shroud and the cover plate 16.

A motor mounting plate 31 is located in the power head just above the fan chambers 20, 21, and it is provided with apertures to receive the upper winding portions of the motor assemblies.

A vacuum chamber shroud 34 is mounted to the motor shroud 11 along the periphery thereof, as will be more fully described below. The vacuum chamber shroud 34 includes a cylindrical vertical side wall 35, the lower portion of which extends radially inwardly at 36 to provide a shoulder. The lower portion of the side wall is also cylindrical as seen at 38; and a bottom wall 39 of the vacuum chamber is formed integrally with the partial cylindrical wall 38. An inlet aperture 90 is provided at the center of the bottom wall 39 of the vacuum shroud.

A conventional wire cage 91 is mounted to the bottom surface of the bottom wall 39; and a conventional float member 92 is housed within the cage 91. A float shut off assembly 93 is mounted to bottom wall 39. A cloth bag 94 may be draped over the canister rim 12 and placed to surround the vacuum shroud and cage 91 to filter dust and debris from the air in which the debris is entrained. That air is routed from a conventional intake vacuum hose (not shown) into the reservoir defined by the tank 10, and thence through the cloth bag and aperture 90. The air is forced by the fans housed in the chambers 20, 21 which, in turn, are driven by their associated motors, as is known. The fans and motors are an integral assembly.

Figure 3:
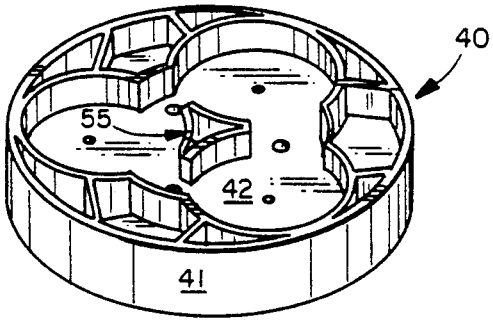
FIG. 3 is a perspective view of the motor mounting adapter in FIGS. 1 and 2.
Figure 4:
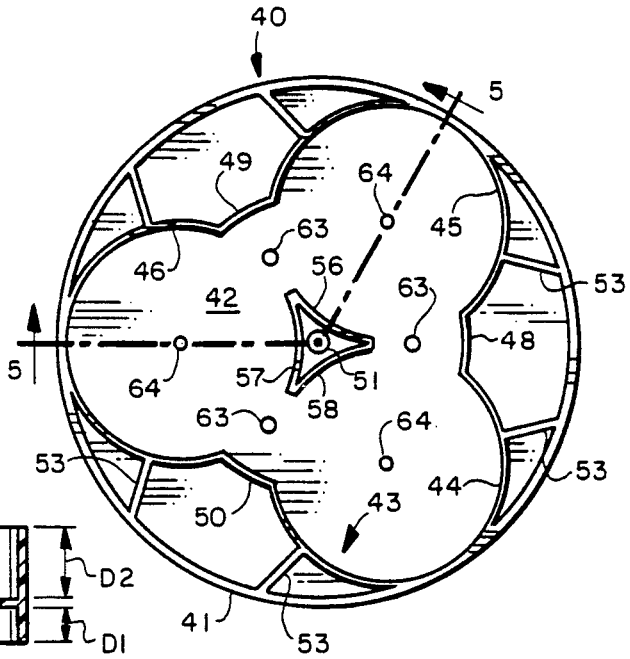
FIG. 4 is an elevational view of the mounting adapter of FIG. 3.
Figure 5:
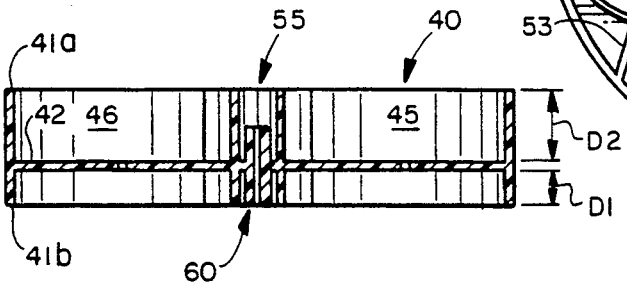
FIG. 5 is a cross-sectional view taken through the sight line 5—5 of FIG. 4.

The fan chambers 20, 21 of the vacuum motors are received in a motor mounting adapter which is generally designated by reference numeral 40. The motor mounting adapter 40 is best seen in FIGS. 3-5. Referring now to those figures, the motor mounting adapter 40 includes a cylindrical peripheral side wall 41 which is sized to rest on the shoulder 36 of the vacuum shroud 34. The motor mounting adapter 40 is an integrally molded rigid plastic member. A transverse support wall 42 is integrally formed with the side wall 41, and it is spaced nearer to one edge 41*a* of the side wall 41 than it is to the other edge 41*b*.

Turning now to FIGS. 3 and 4 in particular, formed integrally with the transverse wall 42, and extending upwardly thereof is an intermediate support wall structure generally designated 43 and including three circular partial wall sections 44, 45 and 46, the outer portions of which are integrally formed with the peripheral wall 41. The three partial wall sections 44, 45 and 46 are sized to receive fan chambers of a uniform size and to engage those chambers in major wrapping engagement—that is, the circular wall sections 44-46 extend more than 180° around the fan chamber of a motor received in the receptacles defined by these walls. Thus, the partial wall sections 44-46 are said to be of major circumference.

The partial wall sections 44-46 are joined by shorter circular wall sections 48, 49, 50 of minor circumference in the sense that they occupy a minor angle or section of the larger circumference fan chamber they are designed to receive. The shorter circular wall portions 48-50 are formed on a common radius of curvature the center of which is located at the center 51 of the peripheral side wall 41 which is also the center of the transverse wall 42. The three partial wall sections 48-50 cooperate to receive a single fan chamber of larger diameter than those received in the receptacles defined by the partial wall sections 44-46 (see FIG. 2).

It will be observed that the three partial wall portions 48-50 are equally angularly spaced so as to contact and secure a larger motor received in the central portion of the adapter. The intermediate wall 48 is strengthened by bracing wall portions 53. A second intermediate wall identical in cross section to that shown at 43 is formed on the opposite surface of the transverse wall 42. This structure is best illustrated in FIG. 5 in which it can be seen that the depth of the receptacles on one side of the transverse wall 42 (as represented by the arrow designated D1) is shallower than the depth of the corresponding receptacle on the other side of the transverse wall 42 (represented by the arrow D2 in FIG. 5). Even though the intermediate wall structures on the respective sides of the transverse wall 42 are dimensioned to receive fan chambers of identical circumferences, the invention is not necessarily limited to that purpose, as persons skilled in the art will readily appreciate.

Still referring to FIGS. 3-5, a center wall section generally designated 55 is formed about the center of the transverse wall 42; and it includes three partial wall sections 56, 57 and 58 of minor circumference in the sense that they form a small angular sector of the vacuum canister they are designed to receive. The partial center wall sections 56, 57 and 58 are formed on the same radius as the partial wall sections 44-46, and they cooperate respectively with the partial wall sections 45, 46 and 44 to further define the receptacles for receiving associated fan chambers. Persons skilled in the art will readily appreciate that the angular extension of the partial wall sections 44-46 and 56-58 may vary widely depending on the application, as may the sections 48-50, as long as they adequately retain the canisters they are designed to secure.

Figure 2:
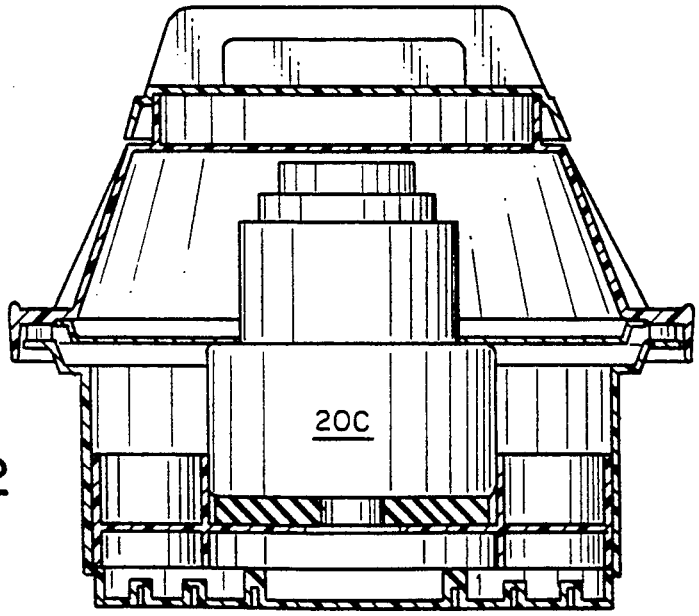
FIG. 2 is a vertical sectional view of the power head of FIG. 1 with an alternate motor configuration.

A corresponding center wall section generally designated 60 in FIG. 5 is formed on the other surface of the transverse wall 42. When it desired to insert a vacuum motor having a fan chamber of larger diameter, such as is seen in FIG. 2, the center wall sections 55, 60 are removed by a hole saw which forms a circular opening in the center of the transverse wall 42, the circumference of the opening being defined by the three formed apertures designated 63 in FIG. 4. When it is desired to use vacuum motors having fan chambers of a smaller diameter, then apertures are cut in the transverse wall 42 centered about the small apertures 64, the number of apertures cut corresponding to the number of motors desired to be used.

In the illustrated embodiment, aperture 96 is formed in the center wall sections 55, 60 to receive a bolt 97 which secures the vacuum chambers between the motor mounting wall 31 and the motor mounting adapter 40, as seen in FIG. 1.

In order to explain more fully the present invention, a specific example will be provided. The vacuum motor and the fan chamber are formed as a single unit. The vacuum chamber may be a two-stage configuration, or it may be a three-stage configuration if greater suction is desired. The three-stage vacuum motor has a fan chamber of greater axial dimension than does the two-stage configuration. Moreover, conventional vacuum motors have different diameters for their associated vacuum chambers. Two conventional sizes are a 5.7 inch diameter motor (meaning that the nominal outside diameter of the vacuum chamber is 5.7 inches), and a 7.1 inch diameter motor. Each of the two different diameter motors come in a two-stage configuration and a three-stage configuration. For example, comparing FIGS. 1 and 6, there are seen two vacuum motors of the nominal 5.7 in. diameter, but the one in FIG. 1 has a two-stage fan chamber 20 whereas the one in FIG. 6 has a three-stage fan chamber 20A.

Figure 6:
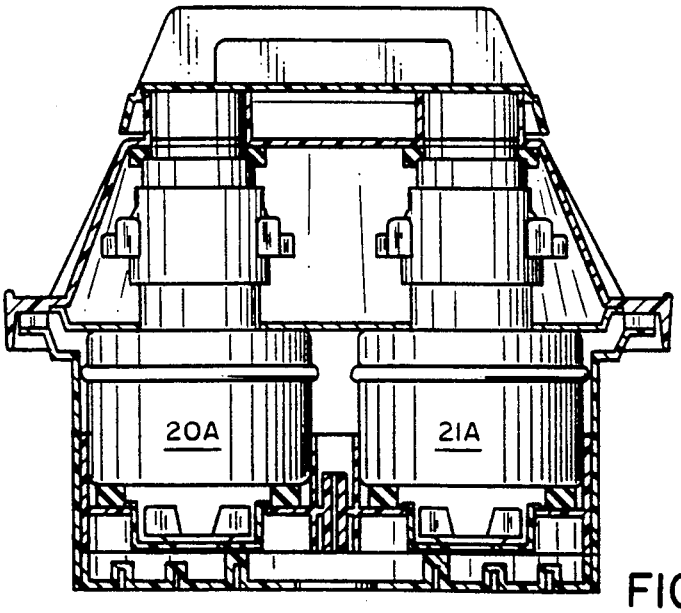
FIG. 6 is a vertical cross-sectional view of the power head employing still another motor configuration.

In order to accommodate the two vacuum chambers 20 or 20A of different axial dimension, the identical mounting adapter 40 is used, but in the case of the configuration of FIG. 1, the more shallow receptacles are employed (corresponding to the depth dimension D1 in FIG. 5), and for the configuration of FIG. 6, the deeper receptacles, corresponding to dimension D2, are employed by inverting the adapter 40.

Similarly, as can be appreciated by observing FIG. 2, when a larger diameter motor having a three-stage vacuum chamber is used, the deeper central receptacle (defined by partial wall sections 48–50) is used as seen in FIG. 2. If the motor **20*c* in FIG. 2 were replaced by a two-stage vacuum chamber, then the motor adapter 40** would be inverted. The center hole that is cut in the transverse wall is the same.

Referring to FIG. 1, an annular gasket 70 is received between the transverse plate 42 of the motor adapter and the bottom of the vacuum chamber 20; and a cup 71 having a central aperture 72 is pressed into the aperture formed in the transverse wall 42. A valve member generally designated 75 is received in the cup 71. The valve member 75 is a conventional member used to avoid re-circulation of air. It has a flat plate 76 and upstanding vanes 77. If a motor is received in the associated receptacle and the motor is energized, then a vacuum is created by the motor, and air flow through the aperture 72 raises the valve member 75. The vanes 77 provide a stand-off relative to the bottom of the vacuum canister so that air flows into the fan chamber 21. However, by way of example, if the motor 18 is energized and the motor 19 is not energized, then the valve member 75 seen on the right-side will be drawn down into sealing engagement with the corresponding aperture 72 on the associated cage 71.

Figure 7:
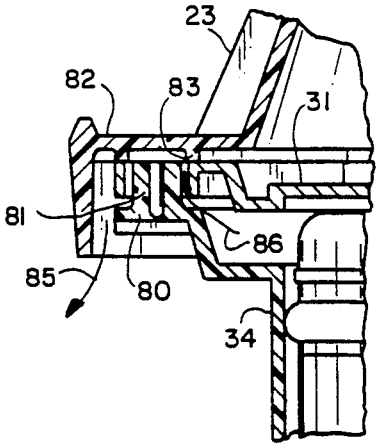
FIG. 7 is a close-up view of the rim attachment structure of the power head.

Turning now to FIG. 7, the vacuum shroud 34 includes a flange 80 which has formed therein a number of bosses 81 spaced about the periphery of the flange 80 for receiving threaded fasteners, such as screws, which secure a corresponding flange 82 of the motor shroud 23. The motor mounting plate 31 is configured so that it is held between the raised bosses on the flange 82, such as seen at 83, and the vacuum shroud 34. The bosses 83 are spaced about the periphery so that motor cooling air may flow radially outwardly and be exited in the direction of the arrow 85; whereas the vacuum air, from which the dust and debris have been removed, is evacuated from the reservoir within the tank 10 in the direction of the arrow 86.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In combination with a canister, a power head coupled to said canister and adapted to generate a vacuum therein comprising: a housing adapted to receive a first vacuum motor of a first axial dimension or a second vacuum motor of a larger axial dimension than said first axial dimension, said housing including a vertical peripheral wall at least partially defining a vacuum chamber and a transverse bottom wall having first and second surfaces; one of said first and second vacuum motors; and a mounting adapter for securing said one motor within said housing, said mounting adapter comprising a vertical outer wall having first and second peripheral edges and adapted to be received within said vertical peripheral wall of said vacuum chamber, a transverse wall integrally formed with said outer wall and spaced at unequal distances from the respective edges thereof, first and second upright intermediate support wall means integrally formed respectively with said first and second surfaces of said transverse wall and extending generally perpendicular thereto, each intermediate support wall means cooperating with said transverse wall to define a receptacle for one of said motors; whereby when said adapter is in one position it defines a receptacle having an axial dimension for receiving said first vacuum motor and when said adapter is inverted, it defines a receptacle having an axial dimension for receiving said second vacuum motor.

2. The apparatus of claim 1 wherein each of said first and second intermediate support wall means comprises an intermediate wall extending parallel to the axis of said peripheral wall and defining a first plurality of partial wall sections of a first radius and adapted to receive respectively one of said first vacuum motors, each intermediate wall structure further including a second plurality of partial wall sections of a larger radius than said first radius and cooperating to define at least one receptacle for receiving one of said second vacuum motors of a larger diameter.

3. The apparatus of claim 2 wherein said first and second partial wall sections are alternately contiguous and form a continuous intermediate wall structure.

4. The apparatus of claim 2 further comprising first and second central wall structures extending respectively from said first and second surfaces of said transverse wall and each defining a plurality of partial wall sections cooperating respectively with associated ones of said first plurality of wall sections to define receptacles for said first vacuum motors, whereby said center wall sections are removed to accommodate said second vacuum motor when desired.

5. In a power head for a vacuum machine, the combination comprising: a housing adapted to receive one or more vacuum motors of a first diameter or a vacuum motor of a second diameter larger than said first diameter, said housing including a vertical peripheral wall at least partially defining a vacuum chamber and a transverse bottom wall; and a mounting adapter for securing at least one vacuum motor within said housing, said mounting adapter comprising a vertical outer wall adapted to be received within said vertical peripheral wall of said vacuum chamber, a transverse wall integrally formed with said outer wall, intermediate support wall means integrally formed with said transverse wall and said outer wall, and including a plurality of first partial wall means adapted to receive at least first and second vacuum motors of said first diameter, said intermediate wall means further defining second partial wall means adapted to receive a vacuum motor of said second diameter in said housing.

6. The apparatus of claim 5 wherein said intermediate support wall means comprises a continuous upright wall extending vertically and wherein said first partial wall means comprise partial wall sections of a first, smaller radius and extending in major wrapping engagement about associated first vacuum motors when said first vacuum motors are received therein, and wherein said second partial wall means includes a plurality of partial wall sections of minor circumference and arranged at equal angular displacements about the center of said second motor when said second motor is received therein.

7. The apparatus of claim 5 wherein said vertical peripheral wall is cylindrical having first and second edges and wherein said transverse wall is spaced at unequal distances from said first and second edges of said peripheral wall.

8. The apparatus of claim 7 further comprising second intermediate support wall means integrally formed with said transverse wall and said outer wall and extending vertically in a direction opposite from said first intermediate support wall means, said second intermediate support wall means including a plurality of first partial wall means adapted to receive at least first and second vacuum motors of said first diameter, said second intermediate wall means further defining second partial wall means adapted to receive a vacuum motor of said second diameter in said housing, whereby said adapter is constructed and arranged to provide a plurality of receptacles for said first motors having a first axial dimension or a plurality of said first motors having a second, different axial dimension, as well as receptacle for one of said second motors having a first axial dimension or a second of said second motors having a different axial dimension.

9. In combination with a canister, a vacuum power head coupled to said canister and adapted to generate a vacuum therein comprising: a housing adapted to receive one or more vacuum motors of a first diameter or a vacuum motor of a second diameter larger than said first diameter, said housing including a vacuum chamber at least partially defined by a vertical peripheral wall and a transverse bottom wall; at least one vacuum motor in said power head, and a mounting adapter for securing said motor within said housing, said mounting adapter comprising a vertical outer wall adapted to be received within said vertical peripheral wall of said vacuum chamber, a transverse wall integrally formed with said outer wall and spaced at unequal distances from the respective edges thereof, first and second upright intermediate support wall means integrally formed respectively with opposing surfaces of said transverse wall respectively and extending generally perpendicular thereto, each intermediate support wall means including a plurality of first partial wall sections for wrapping engagement in receiving at least first and second vacuum motors of said first diameter, each intermediate wall means further including a plurality of central partial wall sections configured to cooperate with said first partial wall sections for securing said first motors in said housing, said intermediate support wall means further defining a plurality of second partial wall sections connected to said first partial wall sections, said second partial wall sections cooperating to define a receptacle for said vacuum motor of said second diameter in said housing.

* * * * *